US006433763B1

(12) United States Patent
Lim et al.

(10) Patent No.: US 6,433,763 B1
(45) Date of Patent: Aug. 13, 2002

(54) PLASMA DISPLAY PANEL DRIVE METHOD AND APPARATUS

(75) Inventors: Geun-Soo Lim; Hwan Yu Kim; Jeong Pil Choi; Yeun Ho Yoo; Seong Hak Moon, all of Kyunggi-do (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/339,209

(22) Filed: Jun. 24, 1999

(30) Foreign Application Priority Data

Jun. 27, 1998 (KR) ..... 98-24611

(51) Int. Cl.[7] ..... G09G 3/28
(52) U.S. Cl. ..... 345/68; 345/63; 345/692
(58) Field of Search ..... 345/63, 64, 88, 345/68, 692

(56) References Cited

U.S. PATENT DOCUMENTS 5,446,344 A 8/1995 Kanazawa ..... 315/169.4
6,115,011 A * 9/2000 Sano et al. ..... 345/64
6,151,000 A * 11/2000 Ohtaka et al. ..... 345/63
6,232,938 B1 * 5/2001 Tsuchida et al. ..... 345/88

FOREIGN PATENT DOCUMENTS

KR 98-4289 3/1998

OTHER PUBLICATIONS

English Translation of Korean Search Report (2 pp.) dated Jun. 23, 2000.
Korean Search Report (2 pp.) dated Jun. 23, 2000.

* cited by examiner

*Primary Examiner*—Steven Saras
*Assistant Examiner*—Christopher J. Maier
(74) *Attorney, Agent, or Firm*—Fleshner & Kim, LLP

(57) ABSTRACT

A plasma display panel drive art capable of restraining a contour noise in a picture displayed on a PDP and reducing a maximum power consumption. The drive art allows one frame to be consisted of a plurality of sub fields each having a different weighting value for brightness so as to display a video signal of gray scale. The plurality of the sub fields are differently arranged along with a distribution of logical values in the video data for one frame, thereby dividing the one frame into a display interval and a non-display interval. Also, the plurality of the sub fields are equal to sub fields without a sub field having a least weighting value for the brightness.

17 Claims, 4 Drawing Sheets

PLASMA DISPLAY PANEL DRIVE METHOD AND APPARATUS

BACKGROUND OF THE INVENTION

1. Field of the Invention

This invention relates to a method capable of preventing an appearance of contour noise at which it is driven a plasma display panel in a pulse width modulation to implement a gray scale of picture and an apparatus thereof.

2. Related Art of the Invention

Recently, the plasma display panel, hereinafter PDP, attracts public attention as a display device of slim and light weight. Generally, it uses a modulation allowing the times of emitting light to be proportioned to the video signal in order to display a video signal (for example, a television signal) on the PDP. In detail, the video signal is digitized and each frame period is divided into sub-field periods corresponding to the bit number of a video data digitized. At each sub-field period, the emitting light causes by the times relative to a weighting value of each bit of the digital video data to perform the gray scale display.

Actually, in the case that a picture is displayed in 256 gray scales on the basis of a video data of 8 bits, one frame interval, in which each picture element on the PDP is displayed, is divided into 8 sub field periods SF1 to SF8. Each sub field period SF1 to SF8 is separated again into a reset period RP, an addressing period AP and a display period SP, and the display period SP has the weighting value increasing at a ratio of 1:2:4: . . . :128 according to the sub field periods. The reset period RPP and the addressing period AP come in for a share of each sub field period to be same regardless of the sub field periods. For example, the reset period RPP and the addressing period AP have the term of 1.5 ms, respectively. In such a PDP driving method, the sub field periods opposite to each bit of the video data are proceeded in a fixed sequence, for example SF1→SF2→SF3→SF4→SF5→SF6→SF7→SF8, as shown in FIG. 1. Due to this, a display term and a non-display term appear in one frame period such a manner of a mixed-up state according to the logical value of the pixel data, as shown in FIG. 2. In other words, the display and non-display terms existed in the frame period are arranged in a variety of patterns according the logical value of the pixel data.

As described above, since the sub field periods are proceeded in the fixed sequence, there is generated a contour noise in the picture displayed by the conventional PDP drive method. Actually, the PDP driven by the conventional PDP drive method of PWM system becomes to display the picture depending on the total quantity of the lights emitted during each sub field period. The integration characteristics of the lights is not identified with a visual characteristics accepted by the eyes of human. Due to this, the contour noise is generated in the picture on the PDP. The contour noise appears in the shape of a black stripe or a white stripe on the PDP which displays continuously two frames (or two pictures) having gray scale levels different from each other. In other words, in the case that two gray scale levels such as 127 and 128, 63 and 64,31 and 32 and so on, which allow the emitting light patterns of two frames to be entirely different from each other, are continuously displayed, the contour noise is generated. If the gray scale level of two continuous frames is changed from 128 to 127, the difference of brightness between two frames (or two pictures) is small but a time lag between the emitting patterns of two frames is enlarged to elongate the moving distance of emitting light point. In this case, there is generated the black stripe on the PDP displaying continuously the two frames because the eyes of the human does not follow the emitting point. Also, when the gray scale level of two continuous frames is changed from 128 to 127, the contour noise of the white stripe appears on the PDP displaying continuously the two frames due to the reason as described above. Such a contour noise is generated more when an object of complexion moves. In other words, the contour noise appears more in moving picture that the face or body of human moves. Further, when a color picture is displayed, it is lost a color balance by the contour noise. Furthermore, the contour noise is generated further more by the distribution of the display and non-display terms arranged in one frame period. Consequently, the quality of the picture displayed by the conventional PDP drive method is reduced largely by the contour noise. Also, the conventional PDP drive method consumes a great amount of power since a sustaining signal must be supplied continuously in the non-display term due to the distribution of the display and non-display terms.

SUMMARY OF THE INVENTION

Accordingly, it is an object of the present invention to provide a PDP drive method and apparatus which is capable of restraining a contour noise in a picture displayed on a PDP.

Another object of the present invention provides a PDP drive method and apparatus which is capable of restraining a contour noise in a picture displayed on a PDP and reducing a power consumption.

In order to achieve these and other objects of the invention, a PDP drive method according to one aspect of the present invention allows one frame to be consisted of a plurality of sub fields each having a different weighting value for a brightness so as to display a video signal of gray scale. The sub fields are differently arranged along with a distribution of logical values in the video data for one frame, thereby dividing the one frame into a display interval and a non-display interval.

In a PDP drive method according to another aspect of the present invention, the plurality of the sub fields are equal to sub fields without a sub field having a least weighting value for the brightness, respectively.

Further, a PDP drive apparatus according to still another aspect of the present invention includes: signal input means for receiving a video signal; address drive means for driving address electrodes on the plasma display panel depending on the video signal from the signal input means; a frame memory connected between the signal input means and the address drive means, the frame memory storing temporarily the video signal; sustain drive means for driving sustain electrodes on the plasma display panel; and control means for controlling the sustain drive means to allow one frame to be consisted of a plurality of sub fields each having a different weighting value for a brightness so as to display a video signal of gray scale and to divide a frame period into a display interval and a non-display interval.

Furthermore, a PDP drive apparatus according to still another aspect of the present invention includes: signal input means for receiving a video signal; address drive means for driving address electrodes on the plasma display panel depending on the video signal from the signal input means; a frame memory connected between the signal input means and the address drive means, the frame memory storing temporarily the video signal; sustain drive means for driving sustain electrodes on the plasma display panel to allow one frame to be consisted a plurality of sub fields each having a different weighting value for a brightness; and control means for controlling the sustain drive means to allow one frame to be consisted of a plurality of sub fields without a sub field having a least weighting value for the brightness.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
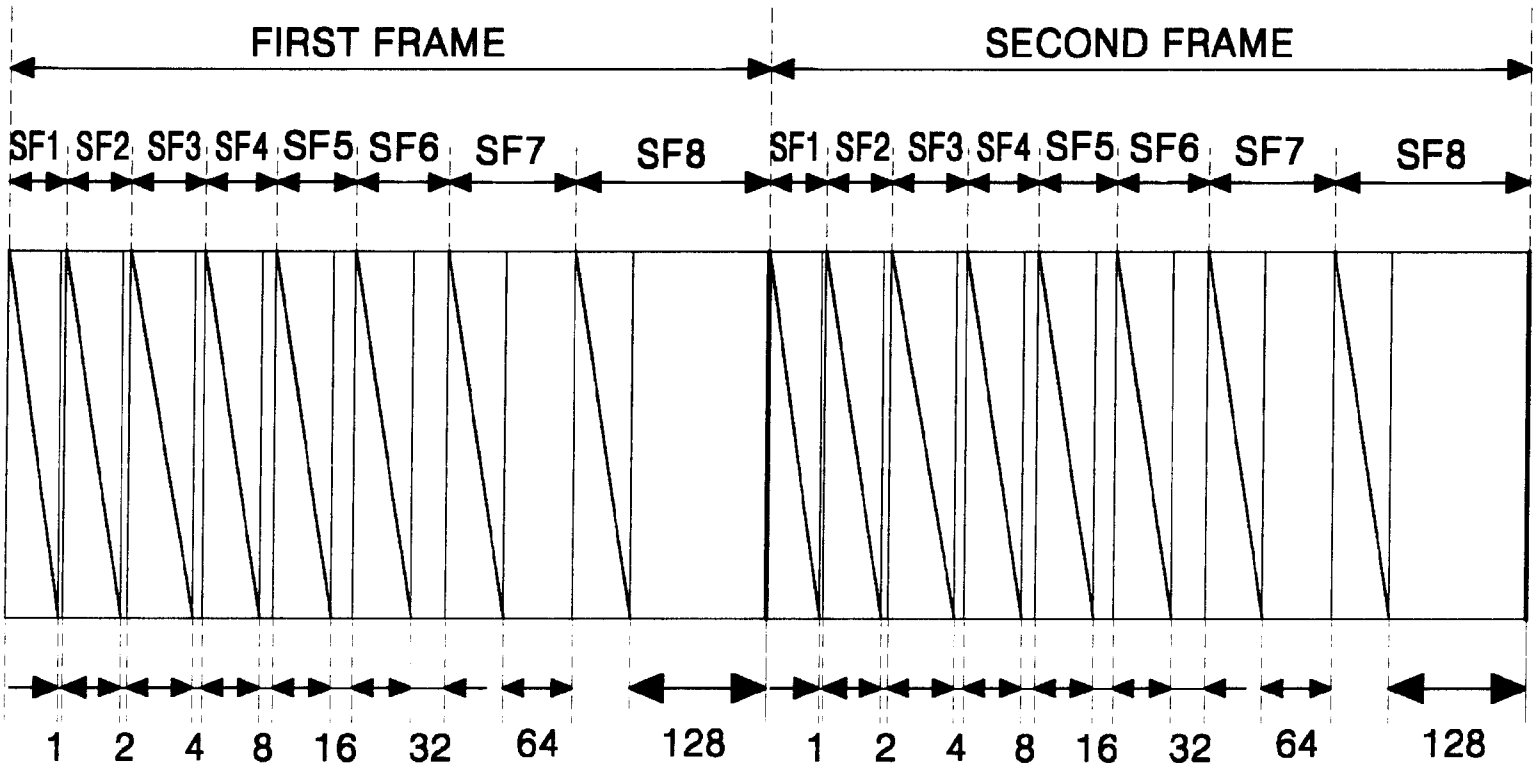
FIG. 1 RELATED ART
FIG. 1 is a schematic view showing a drive sequence according to a conventional PDP drive method.
Figure 2:
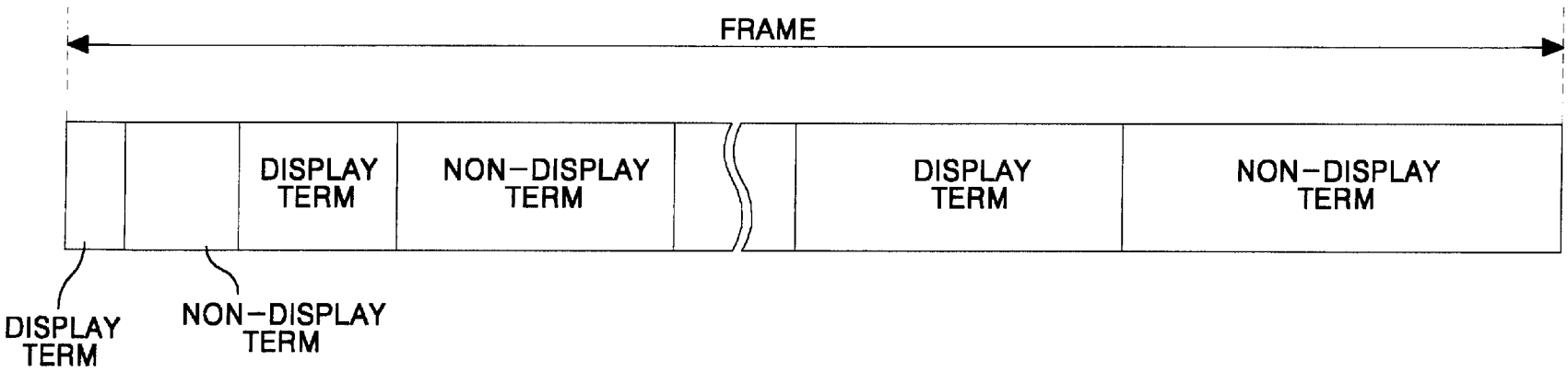
FIG. 2 RELATED ART
FIG. 2 is a schematic view showing the case of video signal driven by the conventional PDP drive method.
Figure 3:
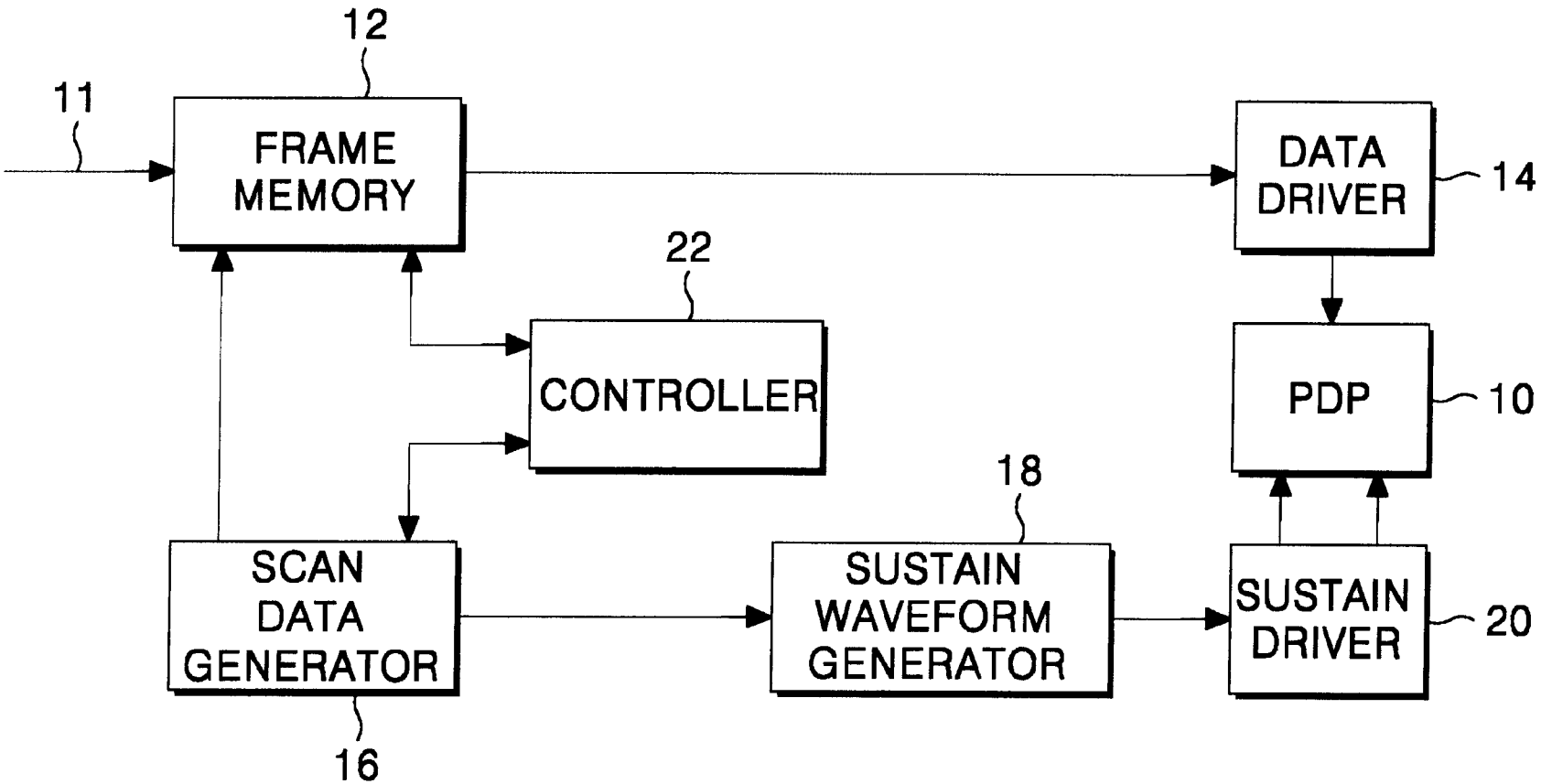
FIG. 3 is a schematic view showing a PDP drive apparatus according to an embodiment of the present invention.

Referring to FIG. 3, there is shown a PDP drive apparatus of an embodiment according to the present invention. The PDP drive apparatus includes a frame memory 12 and a data driver 14 connected in serial between an input line 11 and a PDP 10, and a sustain waveform generator 18 and a sustain driver 20 connected serially between a scan data generator 16 and the PDP 10. A video data having pixel signals of n bits (for example, 8 bits) is applied to the frame memory 12 coupled with the input line 11. The frame memory 12 transmits the video data from the input line 11 to the data driver 14 for one frame. Then, in the video data transmitted from the frame memory 12 to the data driver 14, there are continuously arranged pixel signals of single bit corresponding to the weighting value of sub field. For example, if the PDP 10 is driven during the sub field period having the weighting value of "128", the pixel signals having a most significant bit are continuously arranged in the video data to be applied to the data driver 14. To this end, the frame memory 12 includes a single port memory adaptive to store the video data for two frames or a dual port memory capable of storing the video data for one frame. The data driver 14 drives address electrodes on the PDP 10 depending on the video data from the frame memory 12.

Figure 4:
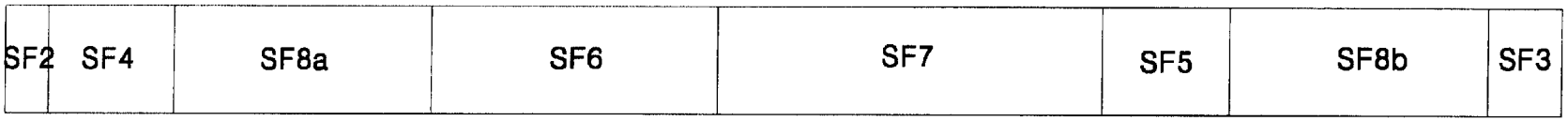
FIG. 4 is a schematic view explaining the case of a drive sequence performed by the PDP drive apparatus shown in FIG. 3.
Figure 5:
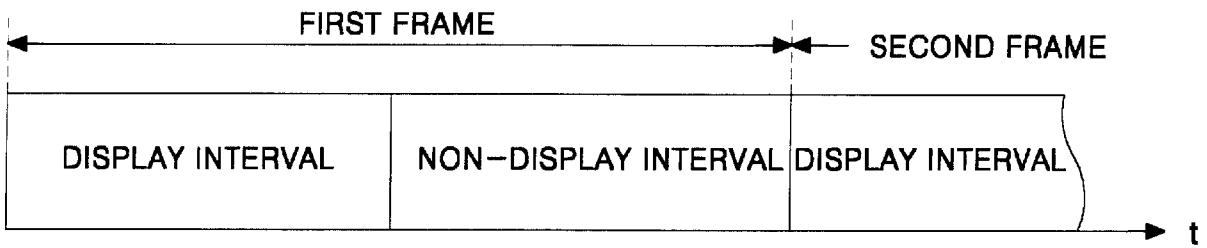
FIG. 5 is a schematic view representing the case of a video signal driven by the PDP drive apparatus shown in FIG. 3.

The scan data generator 16 produces a variety of frame scan pattern according to the distribution of logical values of the pixel signals for one frame, which is stored in the frame memory 12. The frame scan pattern output from the scan data generator 16 is changed every frame unit. On the other hand, the scan data generator 16 can generate the frame scan pattern varied every line unit. In this case, the frame scan pattern is selected according to the distribution of the logical values of the pixel signal for one line. In order to generate the frame scan pattern, the scan data generator 16 stores a plurality of the frame scan patters in accordance with the distribution of the logical value of the pixel signals for one frame or one line. Each frame scan pattern stored in the scan data generator 16 includes sub fields SF2 to SF8, as shown in FIG. 4. The sub fields are arranged regardless of order of the weighting values to reduce a contour noise. In FIG. 4, each frame scan pattern does not include a least significant sub field (hereinafter, first sub field SF1). The first sub field SF1 corresponding to the pixel signal of a least significant bit has a most short period. Such a first sub field SF1 affects largely to the generation of contour noise, while does not affect a gray scale level. Therefore, the first sub field SF1 is eliminated such that the contour noise is largely reduced on the picture displayed by the PDP 10. Also, in the frame scan pattern, a most significant sub field SF8 (hereinafter a eighth sub field SF8) is arranged in such a manner of dividing into two. In other words, the most significant sub field SF8 having the weighting value of 128 for the display period is divided into a pre-sub field SF8*a* and a post-sub field SF8*b*. The pre and post sub fields SF8*a* and SF8*b* each has the weighting value of 64 for the display period. The pre-sub field SF8*a* is positioned between the fourth and sixth sub fields SF4 and SF6, and the post-sub field SF8*b* is inserted between the fifth and third sub field SF5 and SF3. Further, the location of each sub field SF2 to SF8, which are arranged in one frame period with the sequence of SF2, SF4, SF8*a*, SF6, SF7, SF5, SF8*b* and SF3 as shown in FIG. 4, is randomly changed according to the distribution of the logical values of the pixel signals. Since the location of each sub field SF2 to SF8 is randomly changed, the frame scan pattern is separated into the display and non-display intervals as shown in FIG. 5. In this case, the scan data generator 16 disables the sustain waveform generator 18 not to generate a sustain waveform during the non-display interval. Therefore, a driving interval of PDP 10 and a non-driving interval appear in the frame period by once. As a result, in the PDP drive apparatus of an embodiment according to the present invention, the power consumption is greatly reduced. Also, the scan data generator 16 controls a read operation of the frame memory 12 for the video data. In detail, the scan data generator 16 addresses the storing regions of the frame memory 12 to oppose the video data read out from the frame memory 12 to the frame scan pattern. Thus, the frame memory 12 reads out a video data corresponding to each sub field SF2 to SF8 by one frame or one line. Generated is a sustain driving signal in sustain waveform generator 18 which receives the frame scan pattern from the scan data generator 16. The sustain driving signal has the waveform varied along with the frame scan pattern. The sustain driver 20 responds to the sustain driving signal from the sustain waveform generator 18 and drives the sustain electrodes on the PDP 10.

In the PDP drive apparatus of the embodiment according to the present invention, there is included a controller 22 connected commonly to the frame memory 12 and the scan data generator 16. The controller 22 controls the write operation of the frame memory 12 and detects the distribution of the logical values of the pixel signals for one frame. Also, the controller 22 applied the detected distribution of the logical values of the pixel signals to the scan data generator 16 to vary the frame scan pattern output from the scan data generator 16 according to the frame. Further, the controller 22 controls the read timing of the frame memory 12 on the basis of the frame scan pattern output from the scan data generator 16. On the other hand, the controller 22 can detect a distribution of the logical values of the pixel signals on each line among the video data stored in the frame memory 12. In this case, the scan data generator 16 provides with a frame scan pattern varied according to the lines on the PDP 10. Accordingly, the lines on the PDP 10 are driven respectively by the frame scan pattern that the sub fields SF2 to SF8 are arranged differently in each line.

As described above, in a PDP drive apparatus of an embodiment according to the present invention, sub fields are differently arranged along with the distribution of logical values of pixel signals to separate one frame period into a display term and a non-display term. Also, the PDP drive apparatus of the embodiment according to the present invention distributes and arranges an arbitrary sub field, such as a most significant sub field interval corresponding to a most significant bit of the pixel signal, in such a manner of dividing two portions. Accordingly, the PDP drive apparatus restrains the generation of contour noise in a picture displayed on a PDP and reduces the power required driving the PDP. Further, in the PDP drive apparatus of the embodiment according to the present invention, there is reduced more and more the contour noise in the picture displayed on the PDP because of eliminating a least significant sub field period for the least significant bit of the pixel signal.

Although the present invention has been explained by the embodiments shown in the drawing hereinbefore, it should be understood to the ordinary skilled person in the art that the invention is not limited to the embodiments, but rather than that various changes or modifications thereof are possible without departing from the spirit of the invention. Accordingly, the scope of the invention shall be determined only by the appended claims and their equivalents.

What is claimed is:

1. A plasma display panel drive method, comprising:

sub-dividing a frame into a plurality of sub fields, each having a different weighting value for a brightness so as to display a video signal of gray scale; and differently arranging the sub fields along with a distribution of logical values in the video data for the frame to divide the frame into a display interval and a non-display interval, wherein a sub field having a most weighting value among the plurality of sub fields is divided into two portions to be arranged in the frame.

2. A plasma display panel drive method, comprising:

sub-dividing a frame into a plurality of sub fields, each having a different weighting value for a brightness so as to display a video signal of gray scale, the plurality of sub fields being equal to sub fields without a sub field having a least weighting value for the brightness; and differently arranging the plurality of sub-fields along with a distribution of logical values in the video data for the frame to divide a frame period into a display interval and a non-display interval, wherein the sub field having a most weighting value among the plurality of sub fields is divided into two portions to be arranged in the frame.

3. An apparatus for driving a plasma display panel, comprising:

a signal input means for receiving a video signal;

an address drive means for driving address electrodes on the plasma display panel, depending on the video signal from the signal input means;

a frame memory connected between the signal input means and the address drive means, the frame memory storing temporarily the video signal;

a sustain drive means for driving sustain electrodes on the plasma display panel; and a control means for controlling the sustain drive means to allow a frame to include a plurality of sub fields, each having a different weighting value for a brightness so as to display a video signal of gray scale, and dividing a frame period into a display interval and a non-display interval, wherein the control means allows the sustain drive means to divide a sub field having a most weighting value among the plurality of sub fields into two portions to be arranged in the frame.

4. The apparatus as claimed in claim 3, wherein the control means controls the sustain drive means to arrange differently along with a distribution of logical values of the video data for one frame stored in the frame memory.

5. An apparatus for driving a plasma display panel, comprising:

a signal input means for receiving a video signal;

an address driving means for driving address electrodes on the plasma display panel depending on the video signal from the signal input means;

a frame memory connected between the signal input means and the address drive means, the frame memory temporarily storing the video signal;

a sustain drive means for driving sustain electrodes on the plasma display panel to allow one frame to comprise a plurality of sub fields that each has a different weighting value for a brightness; and a control means for controlling the sustain drive means to allow one frame to comprise a plurality of sub fields, excluding a sub field having a least weighting value for the brightness, wherein the control means allows the sub field having a most weighting value among the plurality of sub fields to be divided into two portions to be arranged in the one frame.

6. The apparatus as claimed in claim 5, wherein the control means controls the sustain drive means to separate the one frame into a display interval and a non-display interval.

7. The apparatus as claimed in claim 5, wherein the control means controls the sustain drive means to arrange differently the plurality of the sub fields along with a distribution of logical values of the video data for one frame stored in the frame memory.

8. A plasma display panel drive method for displaying a video signal of gray scale, comprising:

changing one display frame into a plurality of sub fields, each sub field having an addressing interval for selecting a cell to be displayed and a sustaining interval having a unique weighting for a brightness;

arranging the sub fields; and displaying in the cell information representative of the weighting values of the frame according to the sub field arrangement, wherein the action of arranging the sub fields contiguously orders the sub fields to be addressed according to a gray scale level of the video signal and thereafter contiguously orders the sub fields not to be addressed.

9. The method of claim 8, wherein the sub field having a most significant weighting among the plurality of sub fields is divided into two most significant sub fields, each most significant sub field has the same weighting and is arranged and displayed within the frame based on the most significant weighting value.

10. The method of claim 9, wherein one of the two most significant sub fields replaces the sub field having a least significant weighting.

11. An apparatus for driving a plasma display panel, comprising:

a signal input means for receiving a video signal;

an address driver that drives address electrodes on the plasma display panel depending on the video signal from the signal input means;

a frame memory connected between the signal input means and the address driver, the frame memory temporarily storing the video signal;

a sustain driver that drives sustain electrodes on the plasma display panel to allow one frame to comprise a plurality of sub fields, each sub field having a unique weighting for a brightness; and a controller that controls the sustain driver and orders the sub fields; wherein the controller contiguously orders the sub fields to be addressed according to a gray scale level of the video signal and thereafter contiguously orders the sub fields not to be addressed, and the plasma display panel displays information representative of the weighting values of the frame in the cell according to the sub field ordering.

12. The apparatus of claim 11, wherein:

the sub field having a most significant weighting among the plurality of sub fields is divided into two most significant sub fields by the controller, each most significant sub field has the same weighting and is ordered and displayed within the frame based on the most significant weighting value; and one of the two most significant sub fields replaces the sub field having a least significant weighting for the brightness.

13. A plasma display panel drive method, comprising:

changing one display frame into a plurality of sub-fields, each sub-field having a unique weighting for a brightness;

arranging the sub-fields within the frame according to whether a sustaining discharge illumination will occur in the sub-fields; and displaying information representative of the weighted values of the sub-fields in the sequence of the sub-field arrangement, wherein the sub-fields are arranged such that the sub-fields containing information identifying a sustaining discharge illumination are contiguously sequenced in the frame and the sub-fields containing information identifying the absence of a sustaining discharge illumination are contiguously sequenced in the frame.

14. The method of claim 13, wherein the sub-field having a most significant weighting among the plurality of sub-fields is divided into two most significant sub-fields, each most significant sub-field has the same weighting and is arranged within the frame and displayed based on the weighted value of the sub-field.

15. The method of claim 14, wherein one of the two most significant sub-fields replaces the sub-field having a least significant weighting within the frame.

16. An apparatus for driving a plasma display panel, comprising:

a signal input means for receiving a video signal;

an address driver that drives address electrodes on the plasma display panel in accordance with the video signal from the signal input means;

a frame memory connected between the signal input means and the address driver, the frame memory temporarily storing the video signal;

a sustain driver that drives sustain electrodes on the plasma display panel in accordance with information assigned to sub-fields of a display frame, each sub-field having a unique weighting for a brightness; and a controller that controls the sustain driver and orders the sequencing of the sub-fields within the display frame according to whether a sustaining discharge illumination of a cell will occur during display periods corresponding to the sub-fields, wherein the information assigned to the sub-fields determines whether a sustaining discharge illumination of the cell will occur; and the controller contiguously sequences all sub-fields of the frame during which the cell receives the sustaining discharge illumination and contiguously sequences all sub-fields within the frame during which the cell does not receive the sustaining discharge illumination.

17. The apparatus of claim 16, wherein:

the sub-field having a most significant weighting among the sub-fields is divided into two most significant sub-fields by the controller, each most significant sub-field has the same weighting and is arranged within the display frame and displayed based on a weighted value assigned to the sub-field; and one of the two most significant sub-fields replaces the sub-field having a least significant weighting for the brightness.

* * * * *